United States Patent [19]

Pearce et al.

[11] 4,273,186

[45] Jun. 16, 1981

[54] WELL SAFETY VALVE SYSTEM

[75] Inventors: Joseph L. Pearce, Dallas; John H. Yonker, Carrollton; Thomas M. Deaton, Dallas, all of Tex.

[73] Assignee: Otis Engineering Corporation, Dallas, Tex.

[21] Appl. No.: 960,170

[22] Filed: Nov. 13, 1978

[51] Int. Cl.[3] ..... E21B 34/10

[52] U.S. Cl. ..... 166/72; 166/322; 166/324

[58] Field of Search ..... 166/72, 319, 321, 322, 166/324, 329

[56] References Cited

U.S. PATENT DOCUMENTS

| | | | |
|---|---|---|---|
| 3,744,564 | 7/1973 | Mott | 166/72 |
| 3,786,863 | 1/1974 | Tausch | 166/72 |
| 4,026,362 | 5/1977 | Moh | 166/322 |

*Primary Examiner*—William F. Pate, III

*Attorney, Agent, or Firm*—Vinson & Elkins

[57] ABSTRACT

A well safety system comprising a tubing retrievable safety valve adaptable for being connected in a well tubing string with means therein, responsive to pressure, for opening and closing the valve. The tubing retrievable safety valve is to be connected, in the tubing string, below a landing nipple for receiving a secondary safety valve. The safety valve and landing nipple are connected by a common conduit for conducting a suitable pressure fluid for control and balance of the safety valve and a secondary valve landed in the landing nipple. Means are provided on the landing nipple for selectively flushing pressure fluid into the tubing bore. This abstract of the disclosure is neither intended to define the scope of the invention which, of course, is measured by the claims nor is it intended to limit the invention in any way.

21 Claims, 25 Drawing Figures

WELL SAFETY VALVE SYSTEM

BACKGROUND OF THE INVENTION

A. Field of the Invention

This invention relates to a well safety valve system comprising a tubing retrievable valve coupled with a safety valve landing nipple which utilize a dual pressure fluid system and which is capable of having at least the balance line flushed into the well bore.

B. The Prior Art

In subsea production from a well it is desirable to have safety valve means for shuting off the flow from the well in the event of emergency or other event requiring cessation of flow. It is common to incorporate a safety valve in such well, such as a remote-controlled tubing retrievable safety valve. That is, the valve is made up in the well tubing string. Valves suitable for such purpose are illustrated and described at pages 4002 and 4003 of *The Composite Catalog of Oilfield Equipment and Services,* 1974–75 Edition, published by World Oil, Houston, Tex.

Due to the complexity and cost of pulling the tubing string in order to replace a tubing retrievable safety valve (TRSV), in the event of failure, a great effort has been made to provide a method for installing a secondary safety valve within the tubing string, usually within the TRSV itself. This is accomplished by having a tool landing profile inside the bore of the TRSV.

Remote controlled safety valve landing nipples which can be made up in a tubing string are well known in the art. Such landing nipples are illustrated on page 4,004 of *The Composite Catalog of Oilfield Equipment and Services,* 1974–75 Edition, World Oil, Houston, Tex. Such landing nipples are usually included in the tubing string when it is planned to use either through the flow line (TFL) or wire line placement of safety valves.

OBJECTS OF THE INVENTION

It is an object of this invention to provide a dual pressure line operated tubing retrievable safety valve having a back-up safety system.

It is a further object of the invention to provide a dual pressure line operated well safety valve system combining a tubing retrievable safety valve and a separate safety valve landing nipple.

It is a further object of the invention to provide the combination of a tubing retrievable safety valve and landing nipple with common control and balance pressure lines.

It is yet another object of the invention to provide the tubing retrievable safety valve with means to lock open the safety valve and still operate a safety valve landed in the landing nipple using the common control and balance pressure lines.

It is another object of the invention to provide the landing nipple with means to selectively permit access of control and balance pressure fluid, from the common pressure lines, to the bore of the landing nipple while maintaining the tubing retrievable safety valve in the open bore position.

An additional object of the invention is to provide a landing nipple having means to circulate balance pressure fluid into the bore of the nipple without closing the tubing retrievable safety valve and without circulating control pressure fluid into the bore of the nipple.

These and other objects and features of advantage of this invention will be apparent from the drawings, the detailed description and the appended claims.

SUMMARY OF THE INVENTION

A tubing retrievable safety valve having means for controlling flow therebetween and means responsive to pressure for opening and closing said valve;

a control line for conducting a pressure fluid to said valve, a balance line for conducting a pressure fluid to said valve, a landing nipple in the tubing for receiving a secondary safety valve, means connecting said control and balance lines to landing nipple, means for selectively conducting the pressure fluids from said lines to either tubing retrieving safety valve on to landing nipple.

BRIEF DESCRIPTION OF THE DRAWINGS

In the drawings, wherein like numerals indicate like parts, and wherein an illustrative embodiment of the invention is shown:

FIGS. 7A–G are quarter sectional views, partially cut-away, of a remote-controlled tubing retrievable well safety valve connected to a safety valve landing nipple, as illustrated schematically in FIG. 3.

DETAILED DESCRIPTION OF THE PREFERRED EMBODIMENTS

Figure 4:
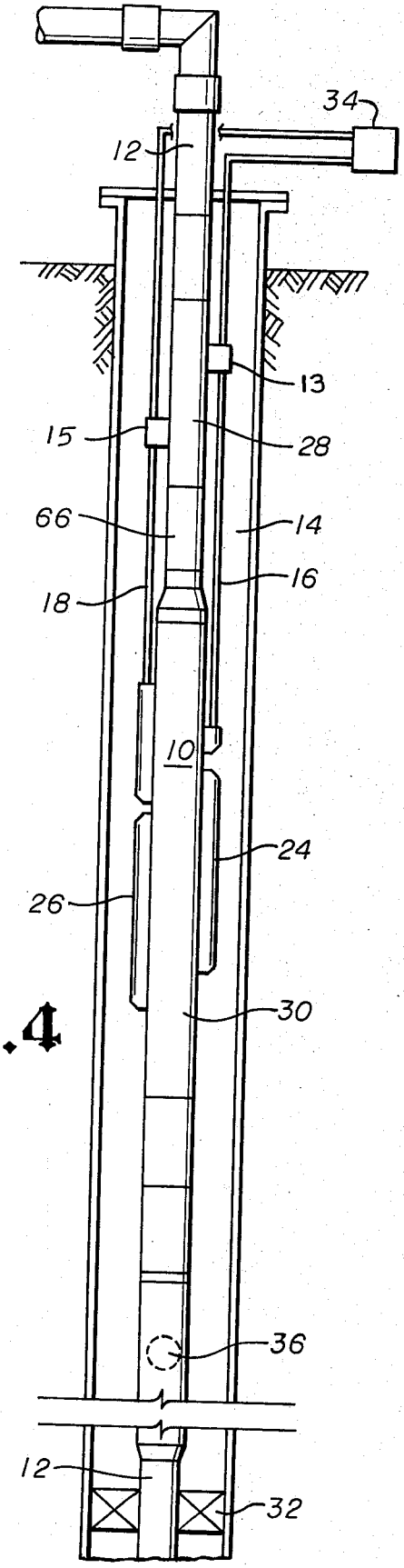
FIG. 4 is a schematic illustration of a well installation incorporating the safety valve system of FIG. 5.

For a complete understanding of the present invention, reference is first made to FIG. 4 which demonstrates the arrangement of one embodiment of the invention, wherein there is provided a tubing string 12, in a well bore 14, packed off with a packer 32 sealing the tubing string in the well. Production fluids are thus forced upward from a producing formation through a safety valve 30 having suitable closure means 36 disposed in the bore of the safety valve 30. The safety valve 30 is known as a tubing retrievable safety valve which means that it is connected in the tubing string. The safety valve is connected to a safety valve landing nipple 28 having a control pressure fluid line 16 entering the landing nipple 28 at 13 and a balance pressure fluid line 18 entering the landing nipple 28 at 15. Pressure fluid conduits 24 and 20 and 26 and 22 conduct control and balance fluids, respectively, therethrough to the safety valve 30. These pressure fluids are operated by manifold 34, usually located at the surface of the well.

When made up in the tubing string in a well, the tubing retrievable safety valve 30 would be placed beneath the landing nipple 28 with a flow coupling 66 connected to each, therebetween. The tubing string bore 10 would traverse the safety valve 30, flow coupling 66 and landing nipple 28.

This arrangement is provided in the tubing string in order to assure that the primary safety valve function would be served by the tubing retrievable safety valve 30 with the landing nipple being in the tubing string to receive a back-up safety valve in the event of failure of the primary tubing retrievable safety valve 30. Thus, in the event of seal failure or some other failure which would render the tubing retrievable safety valve 30 inoperable, the ball closure means 36 could be locked to the full bore open position and a secondary safety valve, either wire line or pump down, could be landed in the landing nipple 28, providing for a surface controlled opening and closing of the tubing string bore.

The tubing retrievable safety valve, illustrated in FIGS. 5A–G comprises a tubular housing member 110, an operator tube 108 disposed within the bore 10 of the valve, with said operator tube axially movable to operate a ball closure member 36 between positions opening and closing the bore 10 of the safety valve. In the closed position, the ball closure means 36 rests against the operator tube seat 37 providing a metal to metal seal to prevent passage thereby of well bore fluids. The operator seat 37 is the lower portion of the operator seat member 10º which is threadedly connected to the operator tube 108.

The complete function and operation of the ball type closure utilized in the present invention is more fully discussed in U.S. Pat. No. 3,703,193 issued to George M. Raulins and assigned to Otis Engineering Corporation. The ball operation is also discussed in U.S. Application Ser. No. 794,410, filed May 6, 1977 by Thomas M. Deaton and assigned to Otis Engineering Corporation, now U.S. Pat. No. 4,140,153.

Figure 5A:
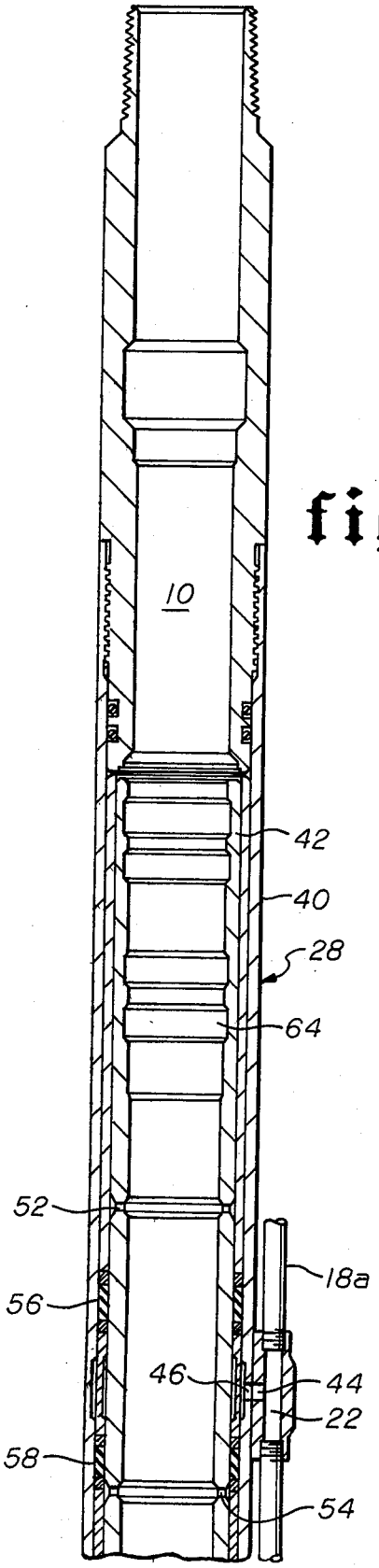
FIGS. 5A–G are quarter-sectional views, partially cut-away, of a remote-controlled tubing retrievable well safety valve connected to a safety valve landing nipple, as illustrated schematically in FIG. 1.
Figure 5B:
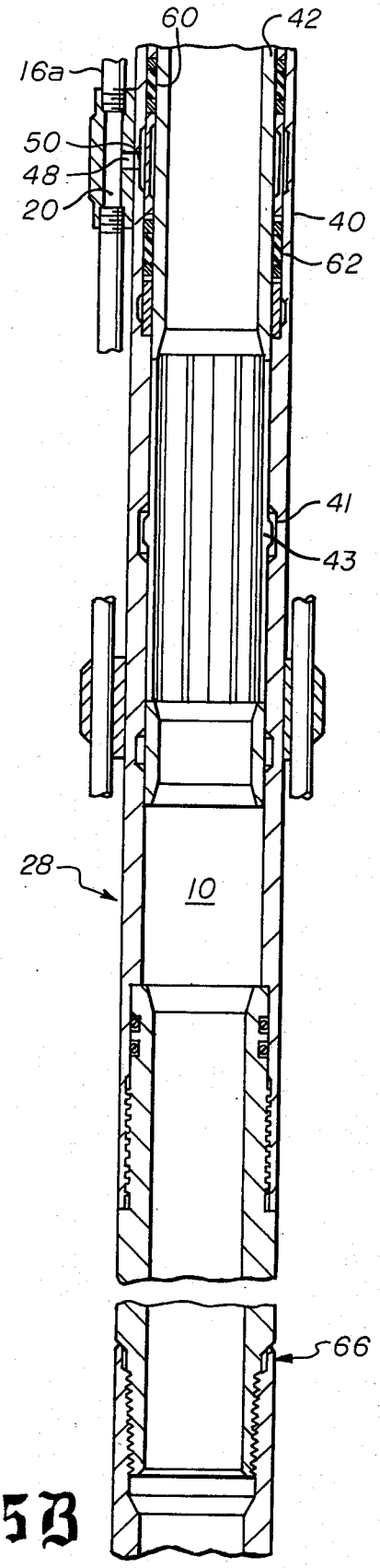
Figure 5C:
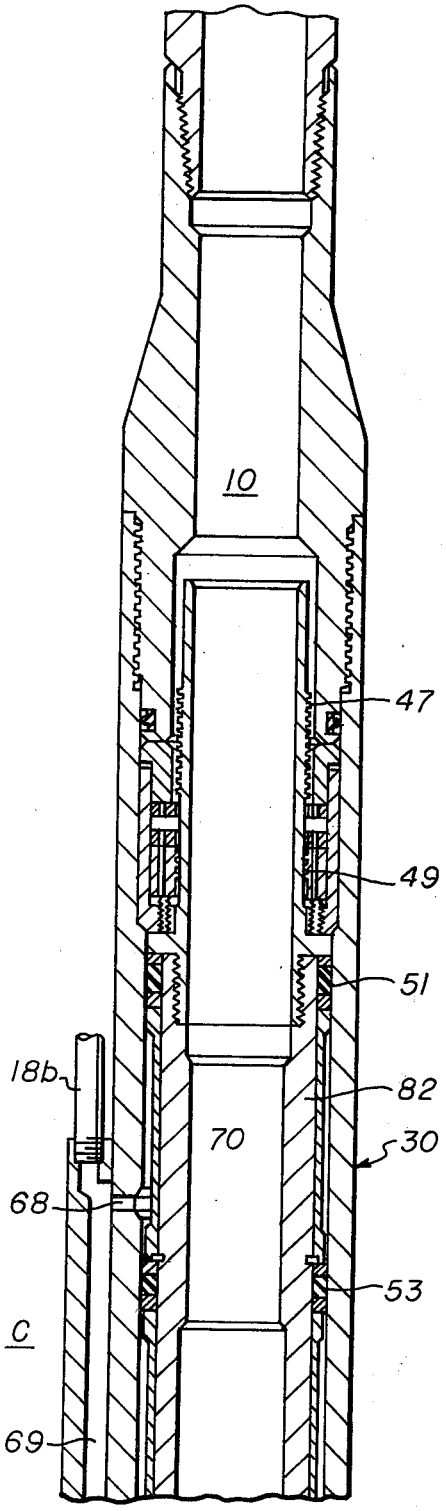

The operator tube 108 is responsive to control fluid pressure, which acts to move the operator tube to a second position wherein the ball closure member 36 is rotated to the full bore open position. Control fluid is conducted first to the landing nipple (FIGS. 5A and B) through conduit **16*a* into a connector chamber 20 and thence through a conduit 16*b* which provides access for control fluid into the tubing retrievable safety valve 30 through passageway 72. The control fluid enters lateral passageway 72, traverses an annular passageway 74, thence through lateral passageway 100 entering a weldment passageway 24 which traverses the outside of the safety valve. As the control fluid traverses the outside weldment passageway 24, it enters lateral passageway 102 and thence through passageway 104 entering an annular zone which connects to a control pressure chamber 106 (FIG. 5E). Manifold pressure at the surface of the well being pressured up to provide operating pressure on the valve causes expansion of control pressure chamber 106. This action causes operator tube 108 to move downwardly opening ball member 36** to the full bore open position.

As will be discussed in more detail hereinafter, as the control fluid enters the passageway 20 of the landing nipple, control fluid is prevented from entering the landing nipple by the position of a sleeve 42 which is axially movable within the landing nipple. As long as sleeve 42 is positioned upwardly in the landing nipple 28, the control fluid port 50 is not provided with access to the bore of the landing nipple (FIG. 5B). This is sometimes known as a "T" connection. Thus, control fluid is directed directly to the tubing retrievable safety valve 30.

In order to close the tubing retrievable safety valve 30 to the passage of well bore fluids therethrough, it is necessary to relieve control pressure in the control pressure chamber 106. This release of pressure would normally cause operator tube 108 to be freed to travel back to its uppermost position which would cause rotation of the ball member 36 upon pin 39 and allow seating of the ball member 36 upon ball seat 37. However, due to the hydrostatic pressure of control fluid in conduit 16, extending to the surface of the well it is sometimes necessary to counteract this force for the valve to close. It is useful to provide a second conduit 18 extending to the surface of the well from the safety valve 30. This conduit is filled with hydraulic fluid and when acting upon the safety valve provides a "balance" fluid to offset the hydrostatic pressure of the control fluid. A chamber 116 is provided in the annular space between the operator tube 108 and the tubular housing member 110, at a position beneath the control pressure chamber 106, for receiving balance fluid from the well surface. Once the hydrostatic column pressure is offset, one or more helical springs, such as illustrated at **112*a* and 112*b*, located in the annular space 118 between the operator tube 108 and the tubular housing member 110, operate to drive the operator tube 108 to its uppermost position closing the valve. These springs 112*a* and 112*b* provide a resilient urging of the operator tube 108** to its upper position.

Well bore fluids may enter this annular space 118 housing the resilient urging means 112 and for that reason suitable sealing means is provided between the annular housing for the resilient urging means 118. These sealing means seal between the operator tube 108 and the tubular housing member 110. As illustrated in FIG. 5E, these seals are shown to be "T"-type seals **117*a*, 117*b* and 117*c*. In the event of failure of seals 117*a–c*, bore pressure would enter balance fluid pressure chamber 116 causing the tubing retrievable safety valve to fail in the closed position. This would be due to the fact that the pressure, if greater than the manifold pressure operating the control pressure chamber 106, would cause the operator tube 108** to be forced to the upper position providing a bore closed mode in the safety valve.

Figure 5D:
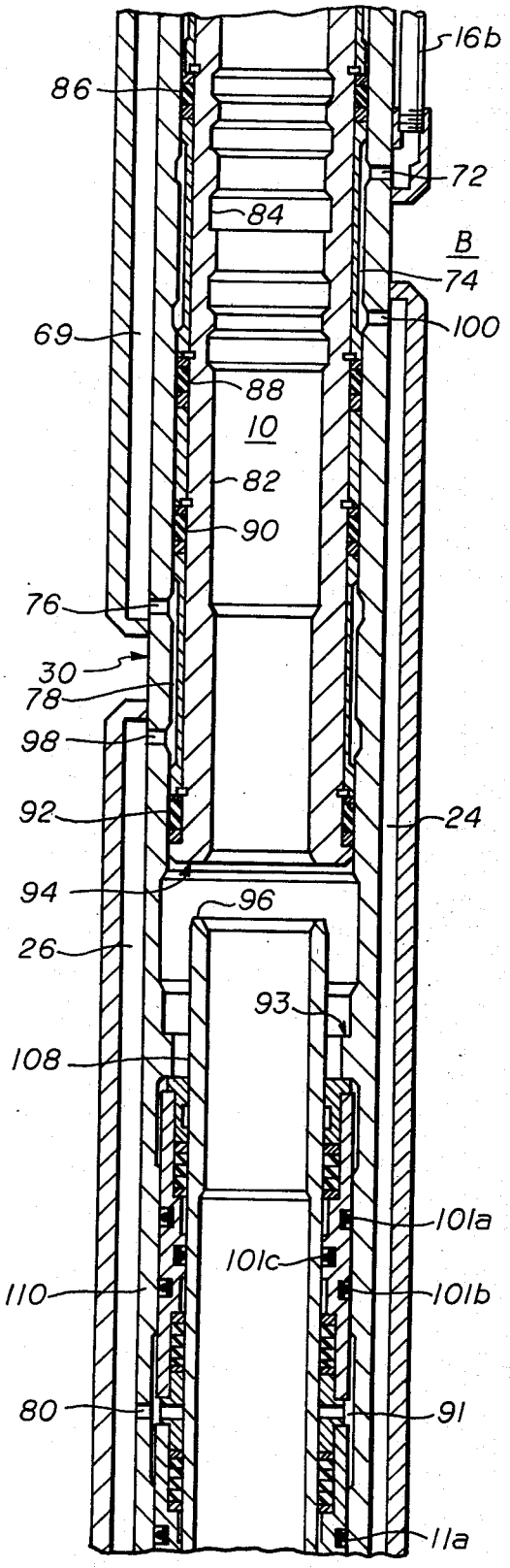
Figure 5E:
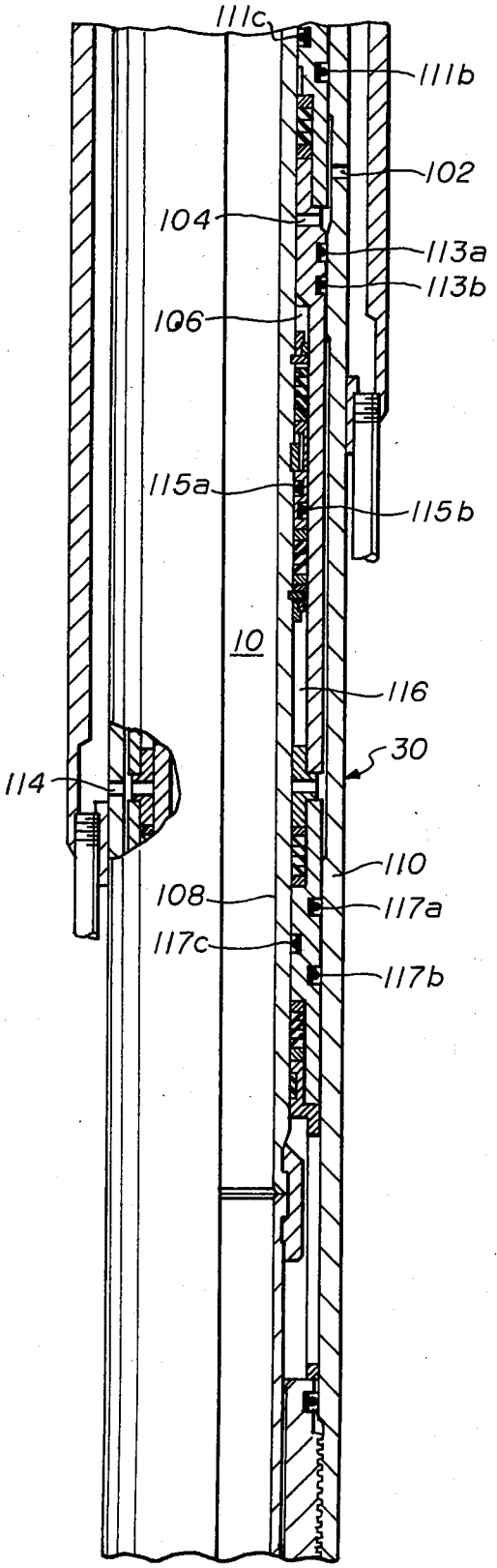
Figure 5F:
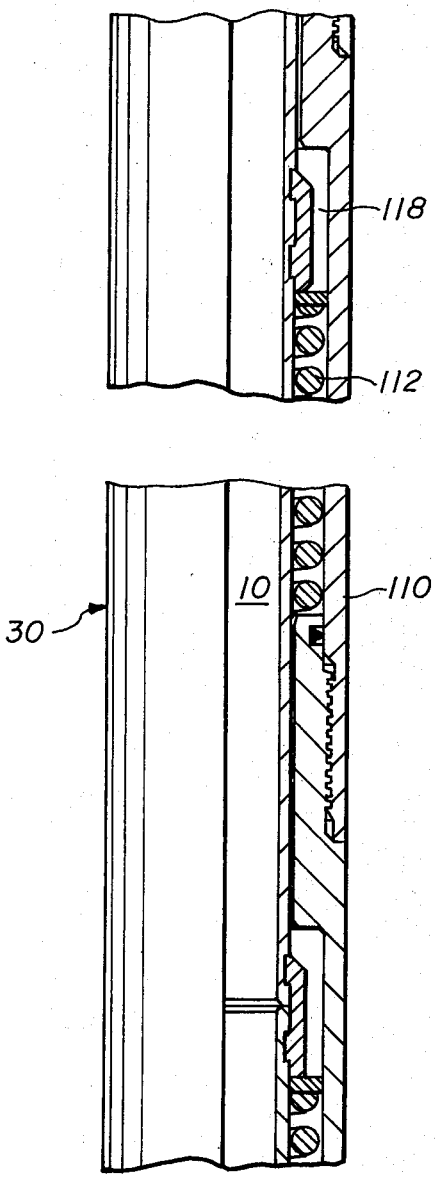
Figure 5G:
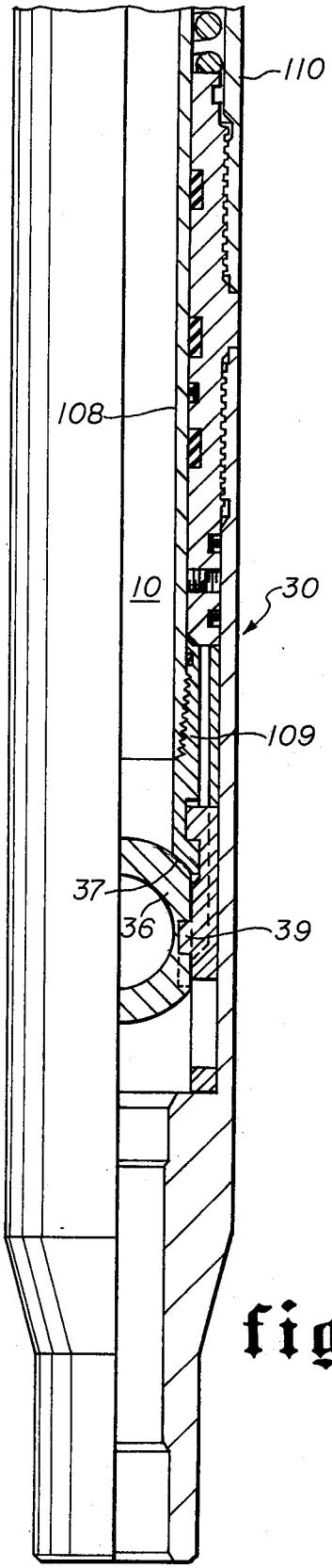

In like manner, there is provided a zone exposed to balance fluid 91 which is on the upper side of the control pressure chamber 106 as shown in FIG. 5D. This balance fluid exposed zone 91 provides protection against inadvertent admission of well bore pressure into the control pressure zone and pressure chamber 106. Balance fluid exposed zone 91 is protected from well bore pressure by annular seals **101*a*, 101*b* and 101*c* which seal between the tubular housing member 110 and the operator tube 108**.

A set of similar seals **111*a*, 111*b* and 111*c* exist between the control fluid pressure chamber 106 and the balance fluid exposed zone 91** to prevent co-mingling of balance and pressure fluid.

Balance fluid, conducted from the surface of the well is directed first through conduit **18*a* into a "T" connection on the landing nipple 28 (FIG. 5A) through balance passageway 22 and thence through conduit 18*b* to a weldment balance fluid passageway 69 (FIG. 5D). Balance fluid travels from the weldment passageway 69 into an annular passageway 78 via a lateral passageway 76 exiting the annular space 78** through lateral passageway 98 and into an additional balance fluid weldment passageway 26. Balance fluid in the weldment passageway 26 enters two balance pressure zones, 91 and 116 in the tubing retrievable safety valve through lateral passageways 80 and 114, respectively.

If there is failure of one of the seals in the tubing retrievable safety valve 30 or it otherwise becomes desirable to cease using the tubing retrievable safety valve, means are provided in the safety valve for taking the valve out of service. In order to do this, it is necessary to rotate the ball member 36 to its full bore open position allowing passage of well bore fluids to pass through bore 10. This is done by use of a sleeve positioned within the bore of tubular housing member 110. The sleeve is designated numeral 82 and has within its bore a profile 84 for securing a suitable shifting tool for movement of the sleeve to a second, downward position (not shown). Shifting tools useful for this purpose are well known in the art and are available from many sources.

The sleeve 82 is normally in the upper position as illustrated in FIGS. 5C and 5D.

The sleeve member 82 is retained in its upper position by suitable detent rings or other means 49 as illustrated in FIG. 5C. It is also customary, at times, to provide a shear pin in this general location so that when it is desired to shift the sleeve 82 the shear pin is sheared and the sleeve is disengaged from a snap ring or C-ring 49 and moved downwardly.

The sleeve within the tubing retrievable safety valve is maintained downwardly by action of one-way teeth projecting outwardly from the sleeve toward the C-ring 49 so that when the sleeve is shifted past the C-ring, teeth 47 engage the restraining means and maintain the sleeve in the downward position.

Downward movement of sleeve 82 causes contact of sleeve shoulder 94 with the upper end 96 of operator tube 108 forcing the operator tube downward until the shoulder of end 94 of the sleeve engages a right angle shoulder 93 on the inside of tubular housing member 110 (FIG. 5D). This downward movement of the operator tube 108 causes the ball member 36 to be rotated to the full bore open position and locks the valve in the open position in preparation for the landing of a secondary safety valve in the landing nipple 28 disposed in the well above the tubing retrievable safety valve 30.

In this locked position, certain control and balance fluid passageways that had been open for the passage of balance and control fluid to their respective operating chambers therein are blocked so that control and balance fluids are then directed into the bore of the landing nipple 28 when that nipple is prepared for receiving the secondary safety valve.

Seal members disposed between sleeve 82 and the inside bore wall of the tubular housing member 110 provide the means for redirecting control and balance fluid flow. These seals are identified in FIGS. 5C and 5D as seals 51, 53, 86, 88, 90 and 92. When sleeve member 82 is shifted downwardly, seal member 90 intersects annular passageway 78, blocking balance fluid flow from weldment balance passageway 69 and weldment balance fluid passageway 26. Control fluid annular passageway 74 becomes blocked by seal member 86 being positioned between control passageway 72 and 100. Thus, with control and balance pressure fluid obstructed from entering the tubing retrievable safety valve 30, such fluids are then directed into the landing nipple 28 when an internal sleeve 42 in the landing nipple 28 is positioned downwardly opening ports to the bore of said landing nipple.

Turning now to the landing nipple illustrated in FIGS. 5A and 5B, it is seen that the landing nipple comprises a tubular housing member 40, with bore 10, having disposed therein a slidable sleeve 42. The sliding sleeve 42 has in its bore a profile 64 for receiving and retaining a wire line or pump down retrievable safety valve (not shown). The sliding sleeve 42 has fluid communications means 52 and 54 which align with entry ports 46 and 50 of the balance and control fluid sources, respectively, permitting access of balance and control fluid to the bore 10 of the landing nipple. With a safety valve positioned in the landing nipple with the sleeve 42 shifted to align these fluid access ports, the balance and control fluids thus enter the landed safety valve to provide operation thereof.

Thus, balance fluid conducted from a source at the surface of the well through conduit 18*a* enters into balance passageway 22, traverses lateral passageway 44, thence through entry port 46 and, with the sleeve 42 shifted downwardly, through balance fluid bore access passageway 52.

In a similar manner, control fluid is directed from the surface of the well through conduit 16*a* into the passageway 20, thence directed laterally through lateral passage 48, entrance port 50 and, with sleeve 42 shifted downwardly through the control access port 54 into the bore 10 of the landing nipple. Suitable seals are provided between the outside of the sleeve 42 and the inside bore of the tubular housing member 40 to protect the balance and control fluid entry ports from exposure to well bore pressure. These seals are designated 56, 58, 60 and 62. Thus, seals 56 and 58 provide protection from entry of well bore fluids into the balance fluid zone 46 while seals 60 and 62 provide protection from well bore pressure for the control pressure zone at 50.

The sleeve is maintained in its upper end and lower positions by a means 43 which provides a securing relation to the inside bore of tubular housing member 40. As illustrated in the drawings, this securing means is provided by a collet 43 which has outwardly extending portion which is housed in recess 41. Thus secured, the sleeve is retained in its upper position. This is provided to permit the passage, through landing nipple 28 of well bore tools for servicing the tubing retrievable safety valve 30 or other well servicing functions beneath the tubing retrievable safety valve. When the sleeve is shifted downwardly, a similar recess is provided or may be provided a distance down the inside bore of tubular housing member 40 for receiving the collet 43 to secure the sleeve in its downward shifted position. In this manner, the sleeve may be shifted downwardly or upwardly in order to test the functioning of the landing nipple prior to landing therein of the secondary safety valve. It may be desirable, for instance, to flush the balance and control lines prior to landing the safety valve in the landing nipple. Thus, in the down position, both control and balance lines communicate with the tubing bore and can permit the flushing of balance and control fluids into the bore prior to landing the safety valve.

Figure 1:
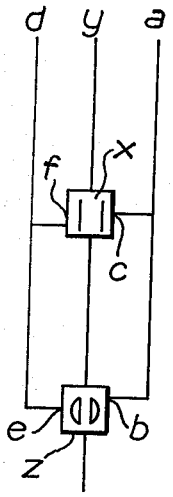
FIG. 1 is a schematic diagram of one embodiment of the well safety valve system of the invention.

A schematic diagram of the landing nipple 28 and tubing retrievable safety valve 30 with control and balance lines is provided in FIG. 1. Referring then to FIG. 1, it can be seen that the tubing string y has disposed therein the landing nipple x and beneath that the tubing retrievable safety valve z. Control fluid from a traverses conduit to the landing nipple x where there is provide a "T" connection and thence down to the tubing retrievable safety valve z at entry b. Balance fluid from d traverses conduit to the "T" connection on the landing nipple x at point f and thence down to the tubing retrievable safety valve z at an entry point e. As described hereinabove, the "T" connections for control and balance fluid at c and f are rendered inoperable by the sleeve therein being maintained in the upper position, thus providing communication for control and balance fluids on down to the tubing retrievable safety valve at points b and e.

When it becomes necessary to lock the tubing retrievable safety valve z in the open position, a sleeve internal of the safety valve z is shifted downwardly, terminating entry of control and balance fluids at b and e. Control fluid from a then is directed into the landing nipple at c with balance fluid from d then being directed into the landing nipple at the connection f for operation of a secondary safety valve landed therein.

A second embodiment of the invention is illustrated in FIGS. 6A through G. As was done hereinabove, a description of this embodiment will be commenced with attention being directed first to the tubing retrievable safety valve 180 illustrated in FIGS. 6B through 6G.

The tubing retrievable safety valve of this embodiment of the invention is quite similar to the tubing retrievable safety valve illustrated in FIGS. 5A through G. Thus, there is provided therein a tubular housing member 182 having disposed in bore 11 thereof an operator tube 194 for opening and closing a ball member 188 to open or close bore 11 to the passageway of well bore fluids. Operator tube 194 is movable to a bore open position by the pressuring of a control fluid pressure chamber 230. The operator tube is moved to the position closing the well bore by operation of a resilient urging means 198 and/or 196 which moves the operator tube 194 to its upper position. The resilient urging means 196 and 198 as illustrated in the drawings is a helical spring disposed in an annular space 200 between the operator tube 194 and the tubular housing members 182*b* and 182*c*. Hydrostatic balancing is provided in a balance fluid chamber 238. The control pressure chamber 230 and balance pressure chamber 238 are disposed in the annular space between the outside of the operator tube 194 and the inside bore of tubular housing member 182. The ball closure member 188, when rotated about pin 192 to its closed position seats against the operator 186 seating surface 190. Operator tube 194 engages a pivot member 193 from which the pivot pin 192 extends and engages the ball member 188. The ball closure member resides at the lower end of the tubing retrievable safety valve and is housed within the portion 182*d* of the tubular housing member 182. The tubing retrievable safety valve 180 is connected at its upper subassembly 174 to a flow coupling 170 which comprises a tubular housing member 172 having a bore 11 for passage of well bore fluids therethrough from the tubing retrievable safety valve 180 to a landing nipple 120 disposed thereabove. When the present invention is installed in a well, made up in a tubing string, the tubing retrievable valve 180 is connected via the flow coupling to the landing nipple 120. Control fluid is conducted from a source at the surface of the well through conduit directly to the tubing retrievable safety valve 180, entering same through control fluid port 202. Control fluid entering the tubing retrievable safety valve 180 at this point traverses a lateral passageway 204 in the tubular housing 182*a*, thence through an annular space 206 which is disposed between the outside of a shiftable sleeve 184, disposed in the bore 11 of the tubular housing member 182, and the bore wall of said tubular housing member 182. Control fluid is then conducted through a lateral passageway 208, traverses the weldment control passageway 210 and enters the variable capacity control pressure chamber 230 via lateral passageways 228 and 229.

Pressuring the control fluid line at the surface of the well causes expansion of the control pressure chamber 230 forcing the operator tube 194 to move downward rotating the ball member 188 to the full bore open position. Hydraulic balance fluid is conducted to the tubing retrievable safety valve 180 by first being conducted to the landing nipple via suitable conduit (not shown), entering the landing nipple balance fluid entry port 136 and traversing the weldment passageway 138 until it enters a lateral passageway 142 which extends through the tubular body portion 122 of the landing nipple. The lateral passage 142 is in fluid communication with an annular passage 144 which extends between the passageway 142 and an exit passageway 146 which again extends through the tubular body member 122 of the landing nipple.

Balance fluid at this point is directed via suitable conduit (not shown) to a point on the tubing retrievable safety valve 180 for receiving the balance fluid. The balance fluid is received into a balance fluid weldment passageway at 212 and traverses the passageway 216 until said passageway intersects a lateral passageway 218 extending through the tubular body 182 to intersect an annular space between the shiftable sleeve 184 and the tubular body member 182. This annular space communicates with a second lateral passageway 222 which provides communication to a second weldment balance fluid passageway 224. Passageway 224 intersects two lateral passageways 226 and 236. These two lateral passageways provide access for the balance fluid to enter the annular space between the operator tube 194 and the tubular body member 182*a*. Passageway 236 communicates with a variable capacity balance fluid pressure chamber 238 via a passageway 237. This balance fluid pressure chamber is expanded or contracts depending upon the admission of balance fluid to the chamber 238.

As in the first embodiment, described above, the balance fluid entering chamber 238 counteracts the hydrostatic column of fluid extending to the surface of the well to offset the hydrostatic pressure in pressure chamber 230 which permits closure of the valve by action of the helical spring member 198. In high pressure service, it is sometimes useful to use additional springs such as illustrated at the numeral 196.

A balance fluid exposed zone 225 on the side opposite control fluid pressure zone 230 from the balance fluid pressure chamber 238 is provided in order to guard the control pressure chamber 230 from exposure to well bore pressure. Balance fluid enters the balance fluid exposed zone 225 by way of a lateral passageway extending between said zone 225 and the balance fluid weldment passageway 224. This upper balance fluid exposed zone 225 is sealed from well bore pressure by a series of O-rings or T-seals, as illustrated, sealing between the operator tube 194 and the inside bore of the tubular housing member 182*a*. These T-seals are designated at 270, 271 and 273. In the event these seals fail, well bore pressure enters the balance fluid exposed zone 225 and traverses a continuous passageway through the balance fluid weldment down to the variable capacity balance fluid pressure chamber 238 causing the control fluid pressure chamber 238 to be overcome, and consequently, forcing the ball valve to be rotated to the closed bore position. As in the first embodiment described above, this provides a fail-closed safety system.

In like manner, the lower balance fluid pressure chamber 238 is sealed from well bore fluids by operation of the seals 260, 261 and 262 sealing between the operator tube 194 and the inside bore of tubular housing member 182*a*.

Well bore fluid by-passing seals 262 or seals 260 and 261 causes well bore pressure to enter the balance fluid pressure chamber 238 again causing the safety valve to be failed in the closed position. These two balance fluid zones provide a unique feature in providing for a fail-closed safety valve. The lower balance fluid pressure chamber 238 is sealed from the control fluid pressure chamber 230 by seals 263 and 264 which lie between the balance fluid pressure chamber 238 and the control fluid pressure chamber 230. Additional seals are provided between the sleeve member 194 and the inside bore of tubular housing member 182. These are seals 265 and 266. Seals 267, 268 and 269 provide a sealing relation between the upper balance fluid exposed zone 225 and the control fluid pressure chamber 230.

In the event of seal failure, or if for any reason it is desired to take the tubing retrievable safety valve 180 out of service, it would be necessary to lock the ball safety valve in the full bore open position. This is accomplished by shifting the upper valve sleeve 184 (shown in FIGS. 6C and 6D) in a downward direction until the bottom edge 240 of the sleeve 184 abuts the upper end of operator tube 194 with further travel downward of the shifting sleeve 184 causing the operator tube 194 to rotate ball member 188 to the full bore open position. The downward travel of the shifting sleeve continues until the lower face 240 of the sleeve 184 abuts a right angle upwardly facing shoulder 242 on the inside of the tubular housing member 182*a*. The sliding sleeve 184 is retained in this position by the action of a series of one-way grooves 183 which are positioned on the outside of the upper end of the sliding sleeve 184. These engage a C-ring 185 which permits the C-ring to expand as these one-way grooves pass therethrough. However, the C-ring 185, engaged with the one-way grooves 183 does not permit the sliding sleeve to be reversed to the upward position.

Placement of seals between the shifting sleeve 184 and the inside bore of the tubular housing member 182*a* permits isolation of the passageways which exist in the annular space between the sliding sleeve 184 and the tubular housing member 182*a* for conducting balance and pressure fluids. From the upper portion of the shifting sleeve, the series of seals are designated 244, 246, 248, 250, 252 and 254. The annular space between seals 244 and 246 provide communication with the balance fluid in the weldment passageway 216. The annular space between seals 246 and 248, with sleeve 184 in the unshifted position, prevents communication of control fluid between control fluid entry port 202 and control fluid exit port 203. When the sleeve 184 is shifted downwardly, seal 248 is moved until it interrupts the passage of control fluid from entry port 202 to weldment control fluid passageway 210. Thus, fluid communication would then exist between control fluid entry port 202 and control fluid exit port 203 providing communication of control fluid back up to the landing nipple 120. Control fluid thus directed up to landing nipple 120 would enter same through control fluid entry port 150 traversing a lateral passageway 152 which extends through the tubular housing member 122 into a control fluid zone 154. This control fluid zone 154 will be discussed in detail hereinafter in discussing the landing nipple 120.

Referring again to the tubing retrievable safety valve 180, when the sleeve 184 is shifted downwardly, annular seal 252 is moved down until it interrupts the flow of balance fluid through the annular space 220 thus denying balance fluid to the balance fluid pressure chamber 238.

It will be noted that even in the downwardly shifted position there is provided the isolation of the control fluid passageways by zones exposed to balance fluid. These zones of balance fluid are between well bore fluid pressure and the area of the tubing retrievable safety valve 180 exposed to control fluid.

When the balance fluid 220 passageway (shown in FIG. 6D) to the balance fluid pressure zone 238 is terminated by the movement of seal 252 to close off passageway 220 balance fluid is then not acting on the tubing retrievable safety valve 184. However, a column of balance fluid does remain in the conduit extending from balance fluid entry port 212 in the tubing retrievable safety valve 180 to the exit port 147 in the landing nipple.

Figure 6A:
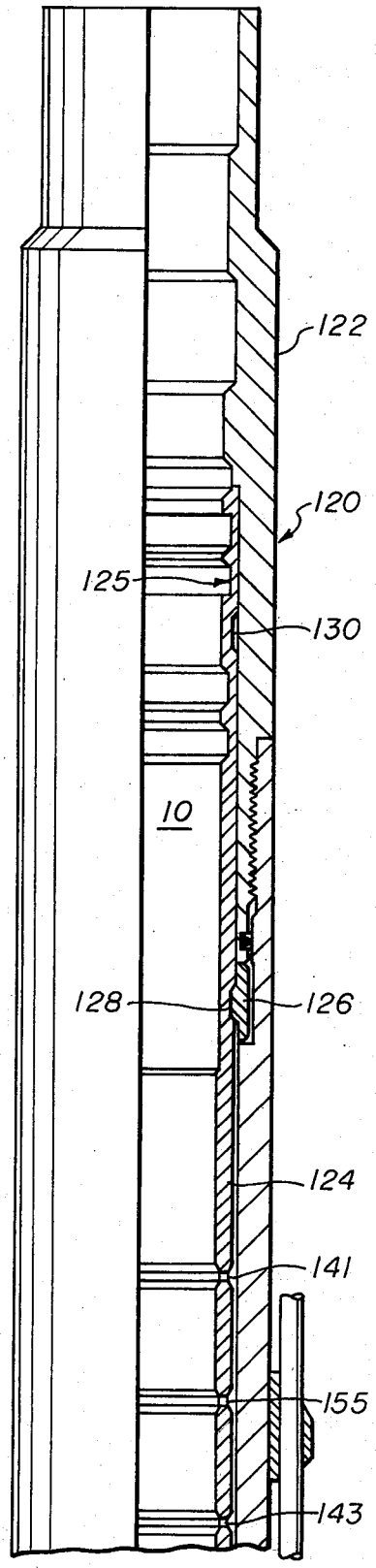
FIGS. 6A–G are quarter-sectional views, partially cut-away, of a remote-controlled tubing retrievalbe well safety valve connected to a safety valve landing nipple as illustrated schematically in FIG. 2.
Figure 6B:
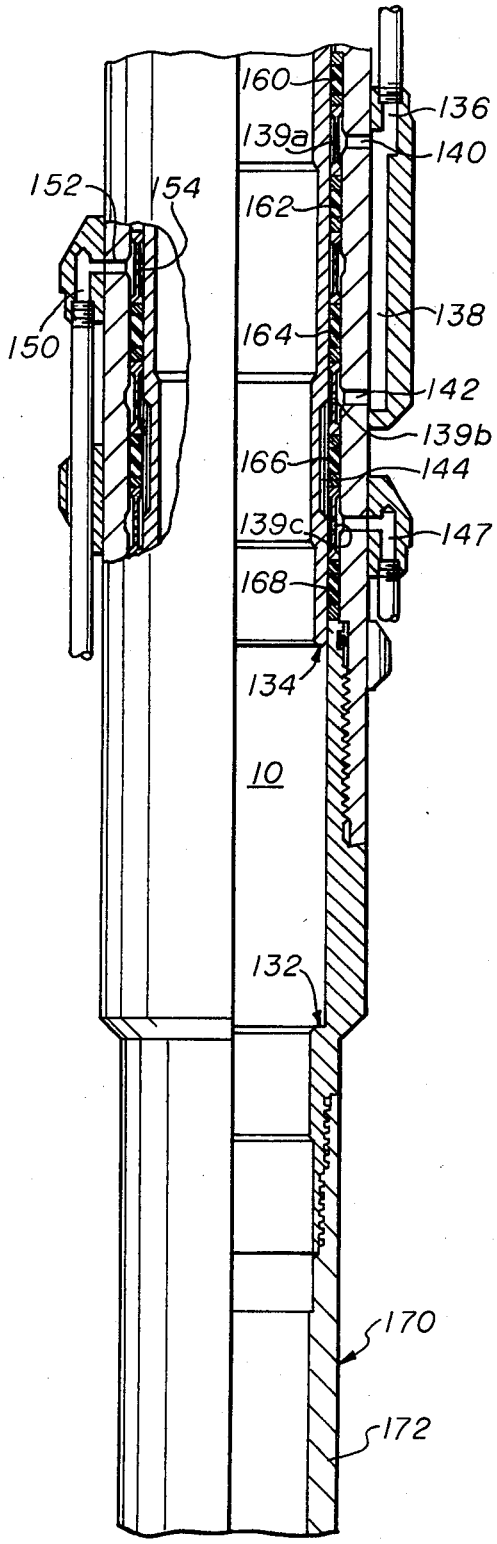
Figure 6C:
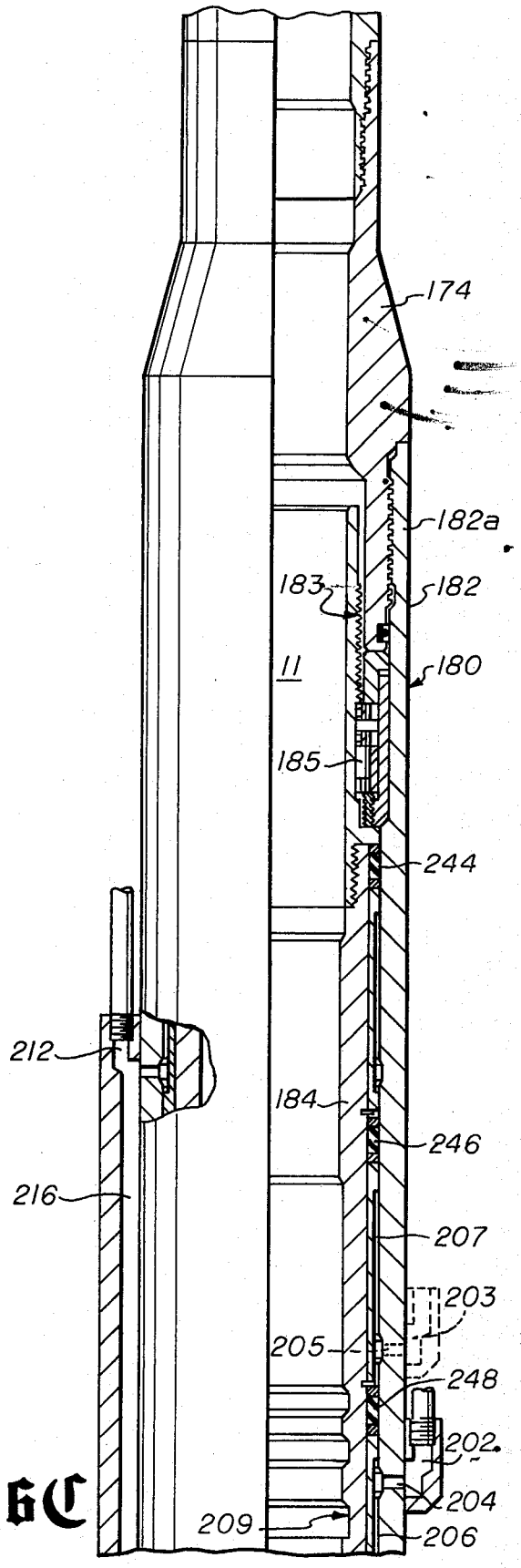
Figure 6D:
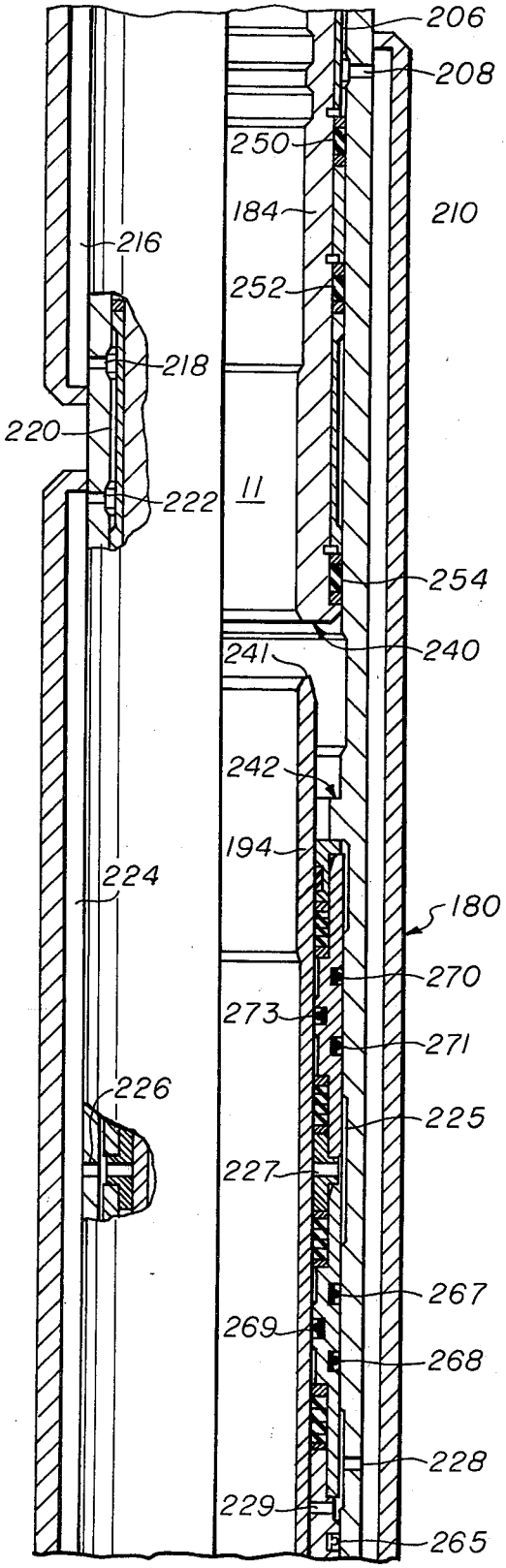
Figure 6E:
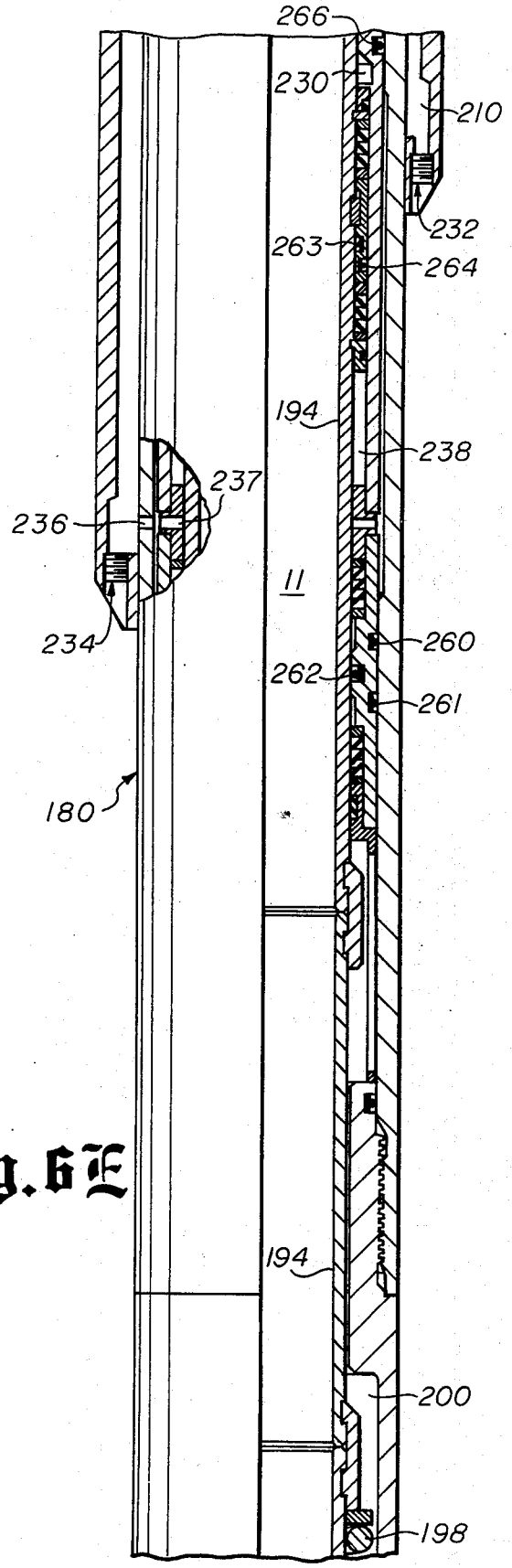
Figure 6F:
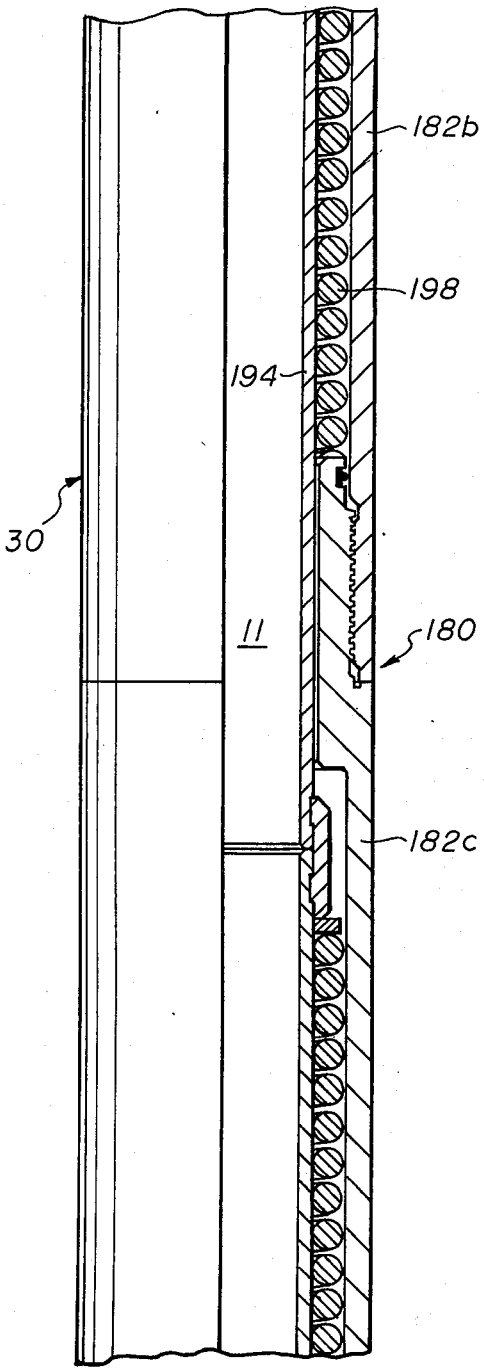
Figure 6G:
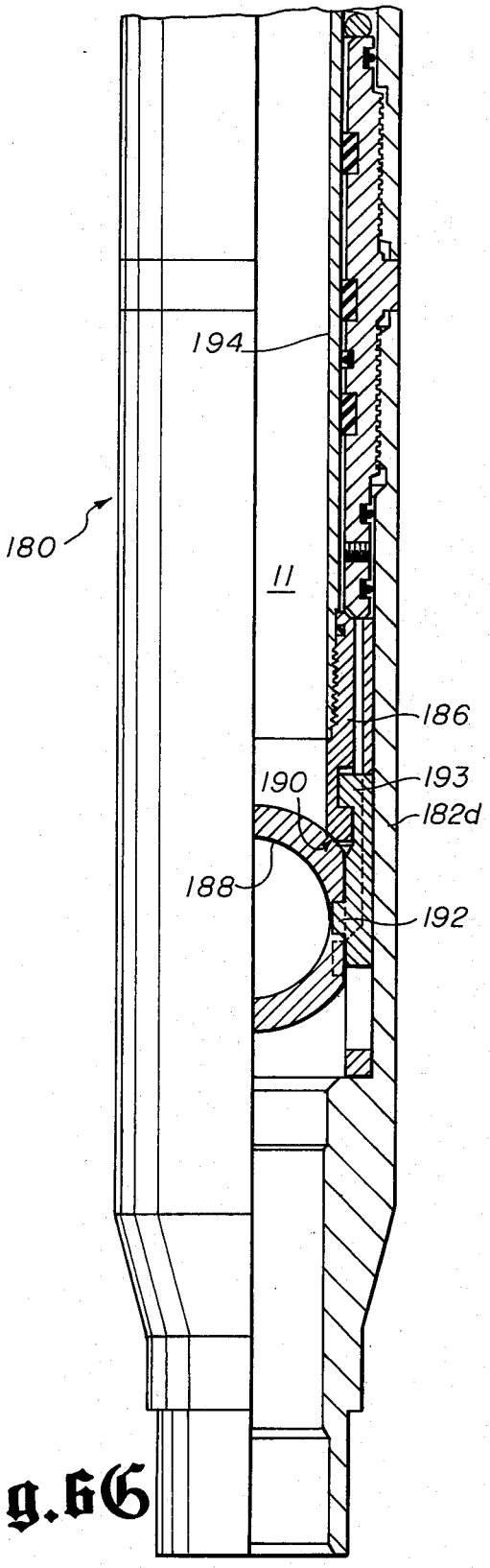
Figure 7A:
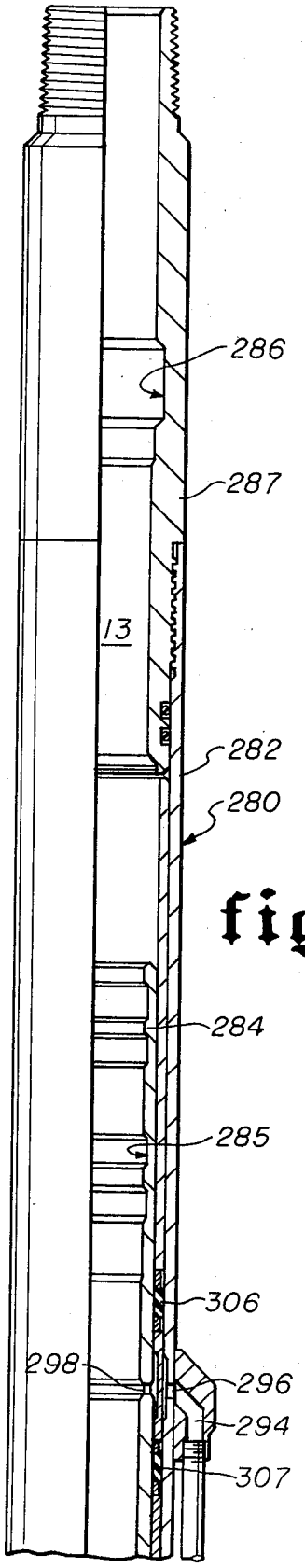
Figure 7B:
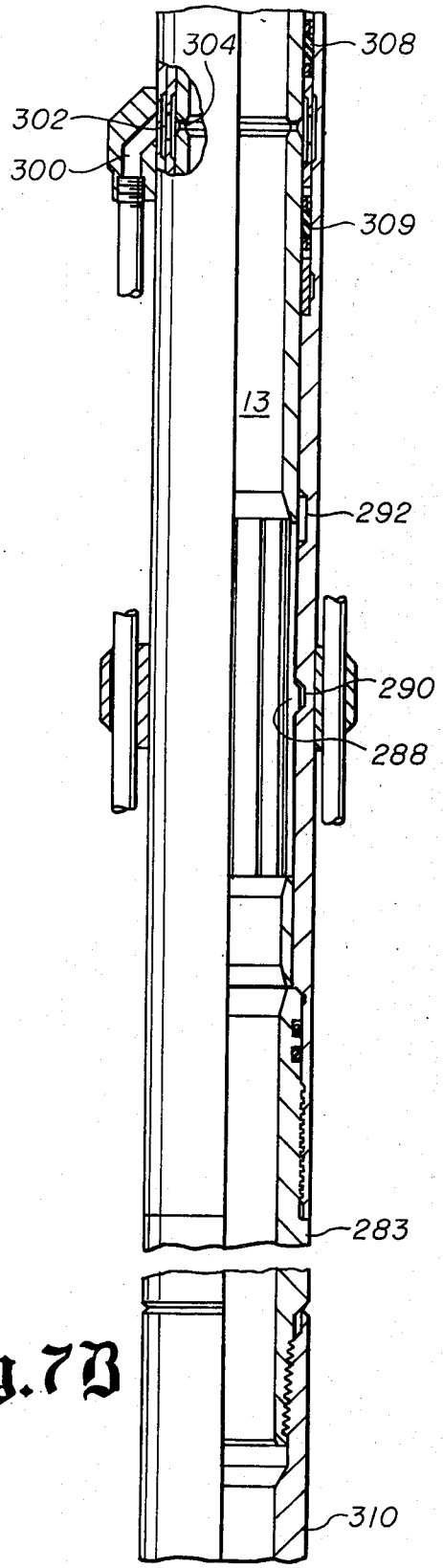
Figure 7C:
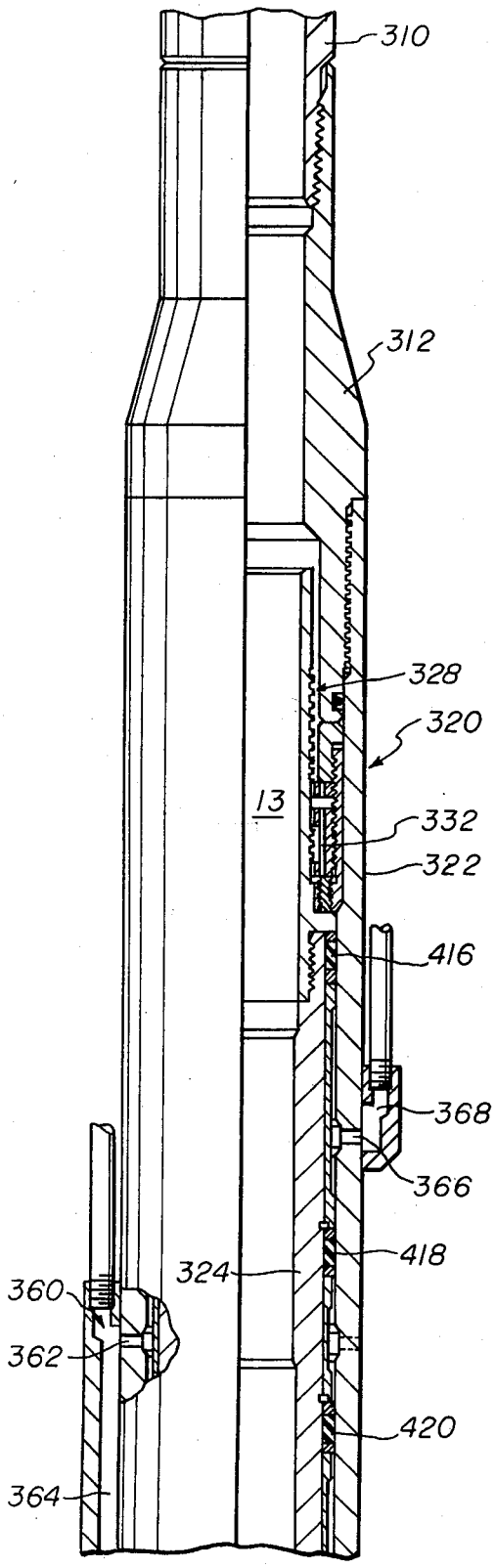
Figure 7D:
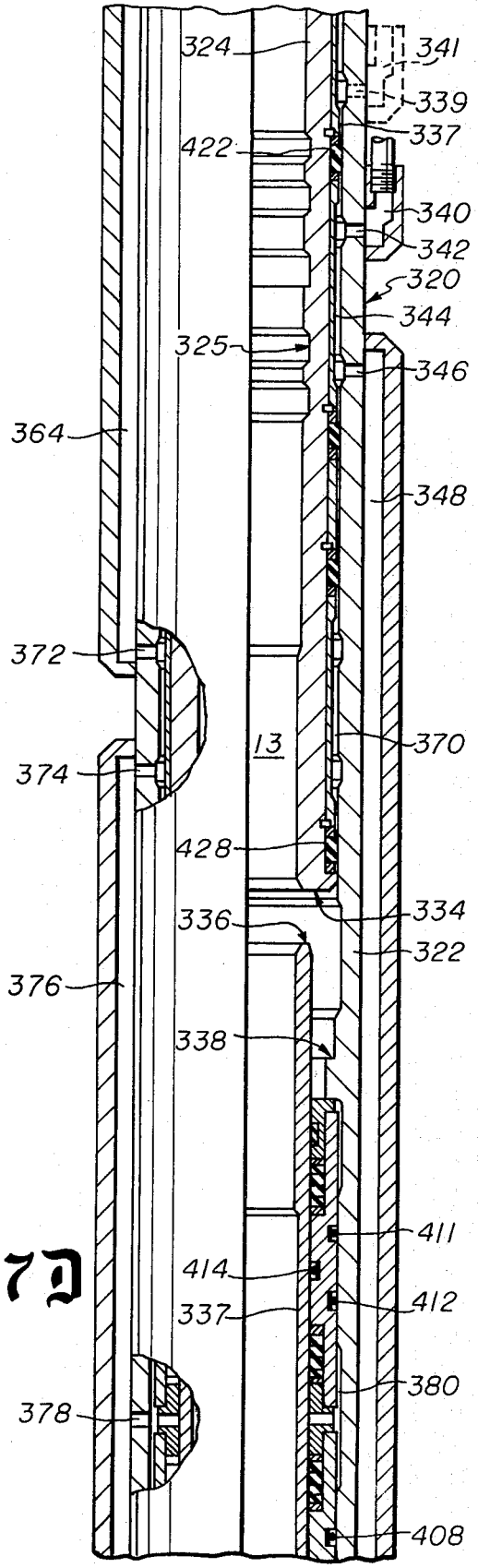
Figure 7E:
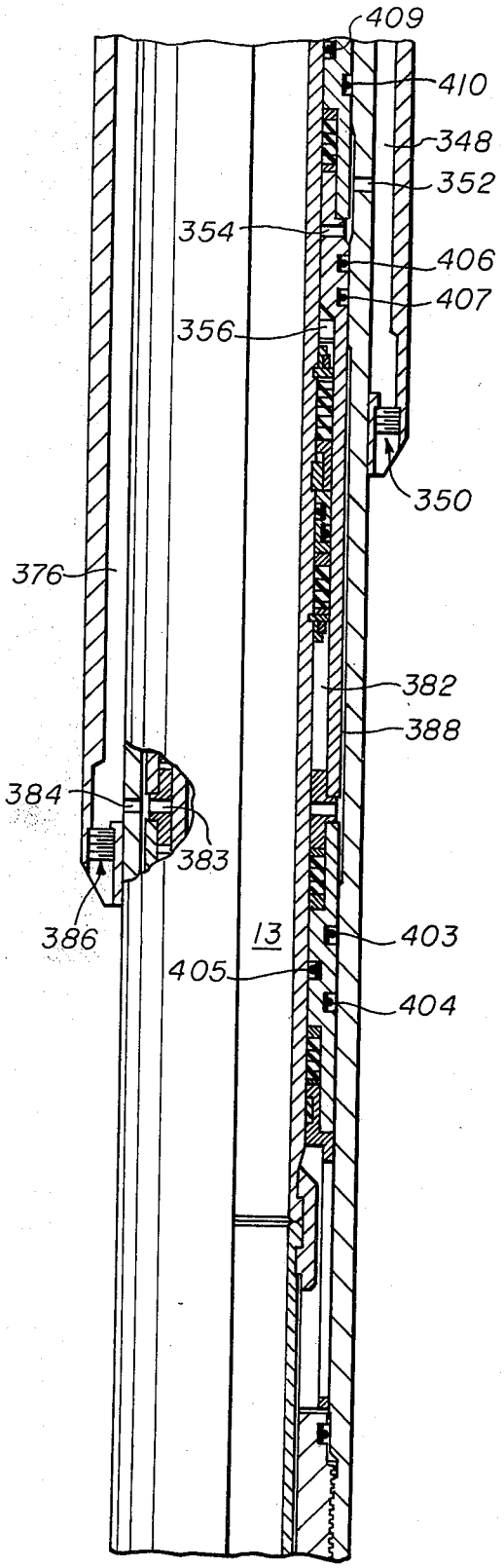
Figure 7F:
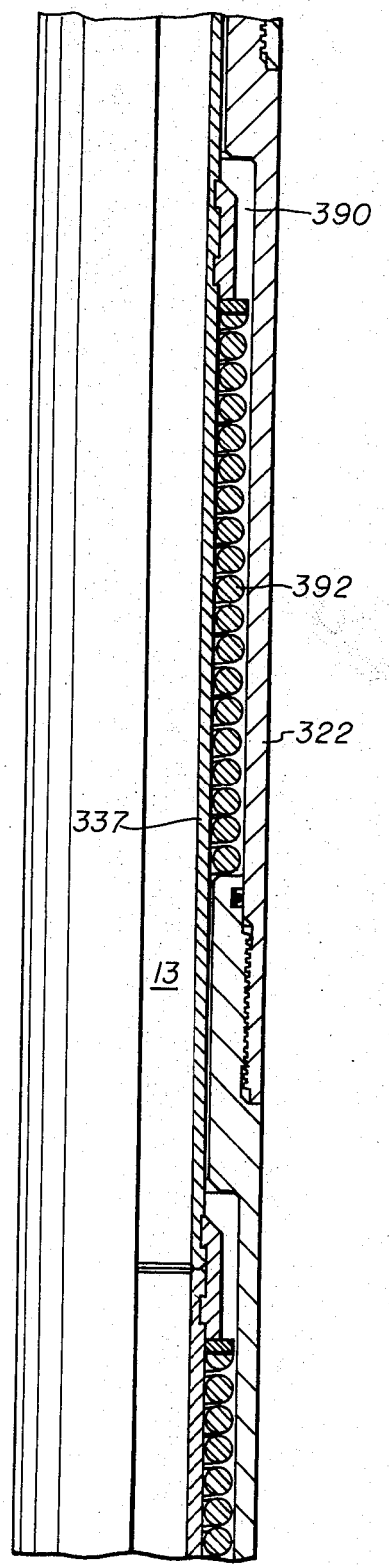
Figure 76:
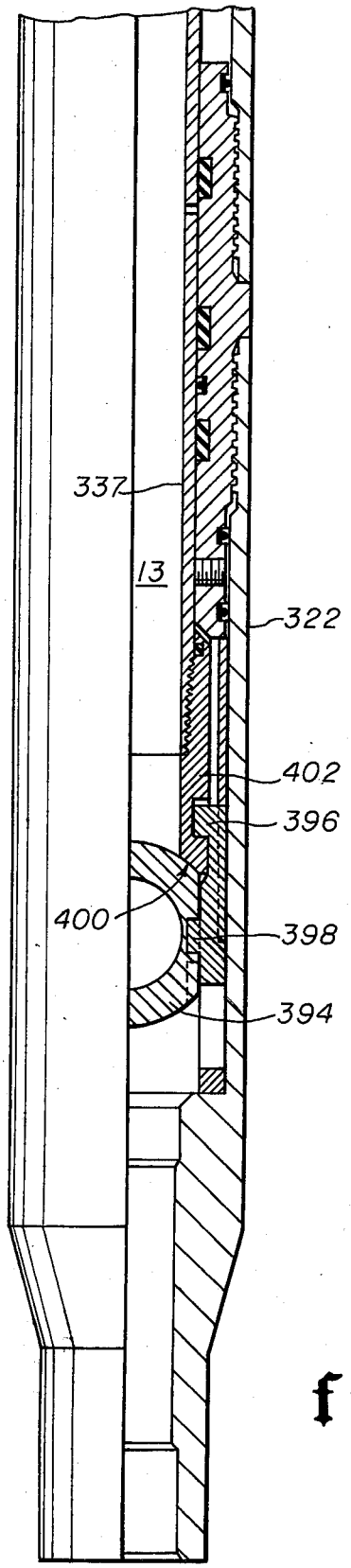

While it appears in FIG. 6E that control fluid terminating at the bottom 232 of the weldment and balance fluid terminating in the weldment at 234 would continue to be conducted out of the respective passageways, in actual practice, a plug is inserted at these two points 232 and 234 at the end of the weldment.

In describing the landing nipple 120, at this point, it should be assumed that the tubing retrievable safety valve 180 has the operator tube 194 forced down locking open the closure means 184. Thus, it is desirable to land a secondary safety valve (not shown) in the landing nipple 120. Referring to FIGS. 6A and 6B, an internal profile 125 is on the inside of the sliding sleeve 124 which is positioned within the tubular housing member 122 of the landing nipple. Profile 125 is used to secure a secondary safety valve (not shown) landed in said landing nipple 120.

In the embodiment of the landing nipple shown in FIGS. 6A and B the sleeve 124 is retained in its upper unshifted position by a snap ring 126 being engaged with a detent 128 in the outer surface of the sleeve 124. In the shifted position, the snap ring 126 would engage detent 130 which is positioned further up the sleeve 124 from detent 128. This permits shifting of sleeve 124 to the downward position for testing the flow communication paths for balance and control fluids. Thus, it is possible to land a dummy safety valve in the landing nipple 120, shift sleeve 124 down and flush balance fluid into the bore 11 of the tubing string. In the event that well bore fluids have contaminated the balance fluid conduits by getting past seals that are positioned between the sleeve and the inside bore of the landing nipple tubular housing member 122 it is possible to clean out the balance fluid lines by this flushing operation. When the lines have been flushed, the sleeve 124 can then be shifted back to its upper position until the snap ring 126 engages the detent 128.

When the sleeve 124 is shifted to its lowermost position, the lower face 134 of the sleeve engages a right angle upward facing shoulder 132 which is on the inside bore of the tubular housing member 122. In this position, it is also possible to flush the balance line with the tubing retrievable safety valve 180 still in working condition and open. Using either wire line or pump down methods, the dummy safety valve is landed in the sleeve 124 of the landing nipple 120 and operations such as described above are then conducted to flush the balance line. The seals 160, 162, 166 and 168 are provided in the annular space between the outside of sleeve member 124 and the inside of tubular housing member 122 to prevent co-mingling of balance fluids with the control fluid. In addition, seals 160 and 168 prevent well bore fluids from entering the balance fluid lines. Movement of sleeve member 124 does not cause seals 160, 162, 164, 166 and 168 to move. It is to be noted, also, that the placing of the zones exposed to balance and control fluids in the landing nipple also provide for a fail-closed safety valve system in the event of invasion of well bore fluids past seals 160 and 168 into the balance fluid areas 139*a* and 139*c*. The general concept of the fail-closed system is described hereinabove using this system of seals, in the safety valve.

Figure 2:
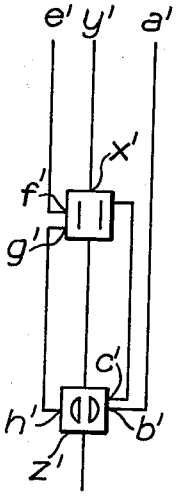
FIG. 2 is a schematic diagram of a second embodiment of the well safety valve system of the invention.

A schematic representation of the flow passages for control and balance fluid is shown in FIG. 2. In this drawing, a landing nipple x' is connected in a tubing string with a tubing retrievable safety valve z' with the landing nipple x' and the safety valve z' connected in the well tubing from a point y' at the surface of the well.

Control fluid from a point a' is conducted through conduit to point b' at the tubing retrievable safety valve z' and thence back to the landing nipple x' entering same at point d'. The exit point for such control fluid on the safety valve z' is at c'.

Balance fluid from a surface source e' is conducted first to the landing nipple x' at point f', traverses an annular passageway therein and exiting from point g' is conducted by conduit to an entry port h' in the tubing retrievable safety valve z'. With the safety valve z' still being pressured to the full bore open position by the force of pressurized control fluid from a' to b', the landing nipple x' can be tested by circulating balance fluid into the bore of the tubing string. This is done, as described hereinabove, by shifting the sleeve therein to its downward position. Such shifting of the sleeve does not interrupt communication of control fluid pressure to the safety valve. However, balance fluid is then terminated at the landing nipple and is pumped into the tubing bore at f'. The schematic representation shown in FIG. 2 along with the embodiment of the invention illustrated in FIGS. 6A through G is the preferred embodiment for pump down type operations. This is due to the fact that accidental shifting of the sleeve 124 in the landing nipple 120 does not interrupt control fluid being directed to the tubing retrievable safety valve 180. Thus, there would be no accidental closing of the safety valve 180. In pump down operations, it is necessary to maintain a flow path of well bore fluids in order to conduct the tool string through the tubing. Accidental shifting of the sleeve in the landing nipple x, illustrated schematically in FIG. 1, would tend to cause the safety valve z to rotate to the bore closed position, interrupting the necessary well bore fluid flow therethrough.

A third embodiment of the invention illustrated in FIGS. 7A through G, comprises a tubing retrievable safety valve 320 connected in a tubing string, by means of a flow coupling 310 to a landing nipple 280.

The tubing retrievable safety valve 320 is operated by control fluid pressure and is balanced with a balance fluid pressure. In contrast to the previous embodiment, control and balance fluid are conducted to the tubing retrievable safety valve 320 directly from a source at the surface at the well. By means to be described further hereinafter, the control and balance fluid are redirected from the tubing retrievable safety valve 320 upwards to the landing nipple 280 to operate a secondary safety valve when landed therein. The tubing retrievable safety valve has on its upper end a subassembly 312 for connecting the safety valve 320 to a flow coupling 310. The flow coupling 310 is connected at its upper end to a connector assembly 283 which in turn is connected to the landing nipple 280.

The tubing retrievable safety valve 320 has an internal operating mechanism essentially the same as the two previous embodiments, that is, the safety valve 320 comprises a tubular housing member 322 having bore 13 therethrough for conducting well bore fluids from the producing zone to the surface of the well. Disposed therein is operator tube 337 axially movable therein to a position opening the bore 13 and to a position closing bore 13 to well fluids. The closure illustrated in FIG. 7G is a ball type closure member 394 which is pivoted upon a pivot pin 398 which is projected from the pivot member 396. The pivot member 396 is engaged with the operator seat member 402 which has a seat 400 which is engaged in a metal to metal engagement with the ball member 394. When ball member 394 is seated against seat 400, well bore fluids are prevented from entering the bore 13 of the tubing retrievable safety valve 320. Operator tube 337 is caused to move to its downward bore opening position by a force generated in a control pressure chamber 356. Control fluid from the surface of the well is directed to the tubing retrievable safety valve 320 through conduit (not shown) with the conduit terminating at a control fluid entry port 340 with control fluid entering the tubing retrievable safety valve 320 through a lateral passageway 342, thence into an annular control fluid passageway 344. Control fluid exits this passageway 344 through a lateral passageway 346, thence the control fluid traverses a weldment control fluid passageway 348 to control fluid entry passageways 352 and 354, thence into the control fluid pressure chamber 356. Pressuring of the control fluid by a manifold located at the surface of the well causes expansion of the control fluid pressure chamber 356 causing operator tube 337 to be moved downwardly, rotating ball member 394 to the full bore open position.

Balance fluid conducted to the tubing retrievable safety valve 320 enters the safety valve at entry port 360. The balance fluid is then conducted through the weldment balance fluid passageway 364 to a point intermediate the length of the safety valve where the balance fluid is then conducted through a passageway 372 to an annular space between the inside bore of the tubular housing member 322 and a sleeve member 324 positioned axially in the bore of the tubing retrievable safety valve 320. This passageway 370 communicates with a lower weldment balance fluid passageway via a lateral passageway 374. Balance fluid in this weldment passageway 376 communicates with a balance fluid pressure chamber 382 by means of a passageway 384 through the tubular housing member 322. Balance fluid conducted to the balance chamber 382 from the surface of the well offsets the hydrostatic column of fluid extending from the surface to the control pressure chamber 356.

Thus, with the hydrostatic pressure of the control fluid counterbalanced by the balance pressure in balance fluid pressure chamber 382, the operator tube 337 is urged upwardly to the bore closed position by resilient urging means 392, illustrated in the drawings as a helically shaped spring positioned within the annular space 390 between the tubular housing member 322 and operator tube 337.

The control fluid pressure chamber 356 is guarded from tubing bore pressure by a balance fluid exposed zone 380 which is in fluid communiation with balance fluid weldment passageway 376 via a lateral passageway 378 extending through the tubular housing member 322. As in the previous embodiments of the invention, the balance fluid zones 380 and 382 provide for a fail-closed system in the event well bore fluids manage to leak past seals which are provided in the safety valve 320. The uppermost seals separating the tubing bore pressure from the upper balance fluid zone 380 are T-type seals 411, 412 and 414 which seal against the inside bore of tubular housing member 322 and the outer surface of operator 337. Intermediate seals 408, 409 and 410 provide a sealing function between balance fluid zone 380 and control fluid pressure chamber 356.

Additional seals 406 and 407 provide supplemental sealing between the annular zone 388 exposed to balance fluid and the annular space exposed to control fluid pressure. Seals 403, 404 and 405 provide a sealing relation between the inside bore of the tubular housing member 322 and the outside of operator 337 to prevent contamination of balance fluid in the balance chamber 382 and well bore fluids.

In the event it is desired to remove the tubing retrievable safety valve 320 from operational service in the well, a sliding sleeve 324 is positioned axially within the bore of the tubing retrievable safety valve 320. This sliding sleeve 324 is positioned above operator tube 337. A profile 325 is provided on the inside bore surface of the sleeve 324 for the landing of a shifting tool. Once engaged, the shifting tool can be used to shift sleeve 324 to its downwardmost position where the lower face 334 of the sleeve 324 abuts a right angle shoulder 338 on the inside bore wall of the tubular housing member 322. In moving downward, the lower face 334 of the sleeve 324 comes in contact with the upper face 336 of the operator tube 337 causing the operator tube to be forced downwardly opening the ball closure 394 to the full bore open position.

The sleeve and operator tube are then locked in their downwardmost position by the action of one-way teeth 328 passing underneath a C-ring 332. The one-way teeth 328 are positioned on the outside of the upper end 326 of the sleeve 324. As the teeth move under the C-ring 332, they are prevented from reversing direction, thus locking the sleeve 324 in the downward position. If desired, the sleeve may be secured in the upward position by the provision of a shear pin just beneath the C-ring. Thus, the shear pin (not shown) provides for the retention of the sleeve 324 in the upper position while the tubing retrievable safety valve 320 is in operation. This minimizes the chance of accidental shifting of the sleeve 324 as tool strings are passed through the safety valve in operations beneath same. Thus, when it is desired to shift the sleeve 324, a profile on the shifting tool which engages the profile 325 on the sleeve is then used to force the sleeve 324 down with sufficient force to shear the shear pin engaging the teeth 328 with the C-ring 332.

A series of seals 416, 418, 420, 422, 424, 426 and 428 are positioned on the outside of the sleeve in the annular space between the sleeve 324 and the inside bore of the tubular housing member 332. These seals are carried by the sleeve 324. In addition to providing a sealing protection against inadvertent admission of well bore fluids into the balance and control zones, certain of the seals, when shifted, act to redirect the direction of flow for control and balance fluids.

Thus, the movement of the sleeve 324 downwardly moves seal 418 in a downward direction to provide fluid communication between balance fluid entering the tubing retrievable safety valve 320 at entry port 360 and an exit port 368 for balance fluid to then be directed upwardly to the landing nipple 280, entering same at entry port 294. Thus redirected, the balance fluid can be used in the landing nipple 280 for operation of a secondary safety valve received and set within the landing nipple 280. In a similar manner, shifting of the sleeve 324 downwardly causes seal 422 carried thereon to move to its secondary position providing fluid communication of control fluid from entry port 340 on the safety valve to control fluid exit port 341 and thence back up to entry port 300 on the landing nipple. Thus received, control fluid entering at entry port 300 traverses through lateral passageway 302 and a port 304 providing communication of control fluid into the bore of the landing nipple 280.

In the shifted position, seal 422 also interrupts fluid communiation of control fluid between passageway 342 and passageway 346 in the tubing retrievable safety valve 320, denying transmission of control fluid to the control fluid pressure chamber 356.

Seal 426, when shifted, operates to interrupt the flow of balance fluid between passageway 372 and passageway 374, thus denying pressurized balance fluid from communicating with balance fluid pressure chamber 382. With the safety valve locked open in the full bore open position, control and balance fluid being redirected up to the landing nipple 280 can be circulated into the tubing bore 13 flushing the lines prior to installation of a secondary safety valve seated therein.

However, fluid communication of control and balance fluids to the tubing bore 13 is not permitted unless a sleeve 284 with landing nipple 280 has been positioned downwardly therein. In the downwardly shifted position, sleeve ports 298 and 304 provide fluid communication for balance fluid and control fluid, respectively, to the tubing bore.

A profile 285 is provided in the shifting sleeve 284 so that the secondary safety valve may be landed in the bore of the sleeve. The sleeve 284 is retained in the shifted down position by means of a collet 288 which is engaged in a recess 290 or recess 292. In the shifted down position, the collet 288 engages recess 290 to retain the sliding sleeve 284 in its downwardly shifted position. Provision of a collet type securing means allows multiple shifting of the sleeve for taking the control and balance entry ports 304 and 307 out of communication with control and balance fluids.

An important feature of this embodiment of the invention is the ability to circulate possibly contaminated control and balance fluids into the bore of the well. As in the previous embodiment, this may be done without taking the tubing retrievable safety valve 320 out of service. The embodiment of this invention illustrated in FIGS. 7A through 7G is provided with a lock profile 286 in the upper subassembly 287 of the landing nipple. However, this feature is optional in the operation of the landing nipple 280.

Figure 3:
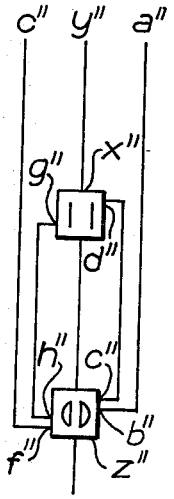
FIG. 3 is a schematic diagram of a third embodiment of the well safety valve system of the invention.

The flow paths for control and balance fluids of this embodiment of the invention, is schematically illustrated in FIG. 3 of the drawings. It can be seen that the landing nipple x" is connected in a tubing from the surface y" with the tubing retrievable safety valve z" positioned therebelow. Control fluid from source a" is directed directly to the safety valve z" entering same at entry point b", exiting the safety valve z" at c" and is then directed upwardly to the landing nipple x" at d". Balance fluid from a source e" is directed to the safety valve z" entering same at f". Balance fluid is directed from the safety valve z" from point h" back to the landing nipple x" entering same at g".

It is to be understood that various modifications of the invention are possible without departing from the scope thereof. For example, features in one embodiment may be employed in other embodiments of the invention.

What is claimed is:

1. A well safety system comprising:

a tubing retrievable safety valve connectable in a tubing string having means for controlling flow therethrough and means responsive to pressure for opening and closing said valve;

a control line for conducting a pressure fluid to said valve;

a balance line for conducting a pressure fluid to said valve;

a landing nipple connectable in said tubing string, spaced from said tubing retrievable safety valve, for receiving a secondary safety valve;

means for connecting said control and balance lines to said landing nipple;

means for selectively conducting the pressure fluids from said lines to either the tubing retrievable safety valve or to said landing nipple.

2. The well safety system of claim 1, wherein the control and balance lines form a continuous passageway from a source of pressure fluid, at the surface of the well, to said landing nipple and to said tubing retrievable safety valve; and means for selectively conducting the pressure fluids from said lines to either the tubing retrievable safety valve or into the well bore at said landing nipple.

3. A well safety system comprising:

a tubing retrievable safety valve connectable in a tubing string having means for controlling flow therethrough and means responsive to pressure for opening and closing said valve;

a control line being in direct communication with said tubing retrievable safety valve for conducting a pressure fluid from a source at the well surface to said tubing retrievable safety valve;

a landing nipple connectable in said tubing string above said tubing retrievable safety valve;

a balance line forming a continuous passageway from a source of pressure fluid, at the surface of the well, to said landing nipple and thence to said tubing retrievable safety valve;

means for conducting pressure fluid from said tubing retrievable safety valve to said landing nipple for control of a secondary safety valve landed therein; and means for selectively conducting the pressure fluids to either the landing nipple, and thence to the bore of said landing nipple, or to the tubing retrievable safety valve, for acting on means therein for opening and closing said tubing retrievable safety valve.

4. A well safety system comprising:

a tubing retrievable safety valve connectable in a tubing string having means therein for controlling flow therethrough and means, responsive to pressure, for opening and closing said tubing retrievable safety valve, a control line in direct communication with said tubing retrievable safety valve for conducting a pressure fluid from a source at the well surface to said tubing retrievable safety valve;

a balance line in direct communication with said tubing retrievable safety valve for conducting a pressure fluid from a source at the well surface to said tubing retrievable safety valve;

a landing nipple connectable in said tubing string above said tubing retrievable safety for receiving a secondary safety valve;

means for conducting control and balance pressure fluid from said tubing retrievable safety valve to said landing nipple for control and pressure balancing a secondary safety valve landed in said landing nipple; and means for selectively conducting the control and balance pressure fluids to either the landing nipple, and thence to the bore of said landing nipple, or to the tubing retrievable safety valve, for acting on means therein for opening and closing said tubing retrievable safety valve.

5. A well safety system comprising:

a tubing retrievable safety valve connectable in a tubing string having means for controlling flow therethrough, said means being responsive to fluid pressure to control and pressure balance said flow control means;

a landing nipple, connectable in said tubing string above said tubing retrievable safety valve, for receiving a secondary safety valve, said landing nipple having means for selectively opening and closing a means for communicating fluid from the exterior to the bore of said landing nipple;

means for conducting a control pressure fluid from the surface of said well to said tubing retrievable safety valve and said landing nipple;

means for conducting a balance pressure fluid from the surface of said well to said tubing retrievable safety valve and said landing nipple; and means for selectively conducting the pressure fluids to either the tubing retrievable safety valve or to said landing nipple.

6. The well safety system of claim 5, wherein the control and balance pressure fluids are conducted to said tubing retrievable safety valve; and said tubing retrievable safety valve having means for redirecting said control and balance pressure fluids to said landing nipple without said control and balance fluids acting upon the means, in said tubing retrievable safety valve, for controlling flow therethrough.

7. The well safety system of claim 6, including means for circulating balance pressure fluids from a source at the surface of the well, to said tubing retrievable safety valve, and thence into the bore of said landing nipple.

8. The well safety system of claim 6, including means for circulating control and balance pressure fluid from a source at the surface of the well, to said tubing retrievable safety valve, and thence into the bore of said landing nipple.

9. The well safety system of claim 5 or 6, wherein said tubing retrievable safety valve has means to allow the flow of well fluids therethrough while control and balance fluids are being circulated to the bore of the landing nipple.

10. A well safety valve system comprising:

a tubing retrievable safety valve connectable in a well tubing string to form a continuous part of a tubing string in a well bore, said safety valve having a bore therethrough, closure means disposed in said bore adapted for movement between positions opening and closing said bore, operator means axially movable in said bore for opening and closing said closure means, means for receiving control pressure fluid and balance pressure fluid to assist said operator means in opening and closing said bore, and a shiftable sleeve axially movable in the bore of said safety valve juxtaposed to said operator means, said sleeve having a first, upper position and a second, shifted position;

a landing nipple comprising a tubular housing connectable in said well tubing string above and spaced apart from said safety valve to form a continuous part of said tubing string, said housing having a bore therethrough and having first and second side ports for communication into the bore through said housing from exterior of said housing, a tubular sleeve valve having first and second side ports therein slidably positioned within said housing and movable between an open position at which said sleeve valve port communicates with said housing port and a closed position at which said ports are isolated from said housing ports for controlling flow of control pressure fluid and balance pressure fluid into the bore of said housing through said side ports in said housing, the tubular sleeve valve being adapted to receive a well tool and being shiftable to either the closed or opened positions in said housing by a force being applied to the received well tool;

a dual flow path for conducting pressure fluid to control and to balance said tubing retrievable safety valve, each flow path communicating a source of pressure fluid to both the tubing retrievable safety valve and the tubular housing; and sealing means to selectively interrupt communication of said balance pressure fluid to said safety valve while maintaining communication with said housing.

11. The well safety system of claim 10, wherein the flow path for conducting pressure fluid to control said safety valve is directed first to said safety valve and then to said tubular housing; and means are provided in said safety valve for maintaining the closure means in a bore open position with control pressure fluid being conducted to said tubular housing.

12. The well safety system of claim 10, wherein the tubular housing has means for circulating balance fluid into the bore thereof while the tubing retrievable safety valve's closure means is in a bore open position.

13. A tubing retrievable safety valve connectable in a well tubing string to form a continuous part of said tubing string comprising, a housing having a longitudinal bore therethrough for defining a flow path for production fluids, closure means disposed in said bore, adapted for movement between positions opening and closing said bore, operator means axially movable in said bore for operating said closure means and having a first position in which said closure means prevents the flow of production fluids through said bore and a second position in which said closure means permits the flow of production fluids through said bore, a variable capacity pressure chamber for receiving hydraulic control pressure fluid from a source at the surface of the well which when essentially fully pressured moves said operator means to its second position, resilient urging means for moving said operator means to its first position upon depressuring said variable capacity pressure chamber, a variable capacity balance chamber positioned between said variable capacity pressure chamber and a zone in said tubing retrievable safety valve exposed to production fluids, with seal means positioned between said chambers, a fixed capacity balance zone in fluid communication with said variable capacity balance chamber, positioned on the opposite side of said variable capacity pressure chamber from said variable capacity balance chamber, with seal means positioned between said fixed capacity balance zone and said variable capacity pressure chamber, seal means disposed between the variable capacity balance chamber and said zone exposed to production fluids, and seal means disposed between the fixed capacity balance zone and a zone in said tubing retrievable safety valve exposed to production fluids.

14. The tubing retrievable safety valve of claim 13, wherein said variable capacity balance chamber is in fluid communication with a source of fluid located at the surface of the well and said balance chamber acts to balance the hydrostatic head of the column of hydraulic pressure fluid entering said variable capacity pressure chamber in order to assist said operator in moving to its first position.

15. The tubing retrievable safety valve of claim 13, wherein said resilient urging means is a spring disposed concentrically around the outside of said operator means within an annular space between said operator means and the inside of said housing, wherein expansion of said variable capacity pressure chamber compresses said spring.

16. The tubing retrievable safety valve of claim 13, including a shiftable sliding sleeve positioned within the bore of said housing, for controlling the access of control pressure fluid to said variable capacity pressure chamber and to lock said operator means in its second position.

17. The tubing retrievable safety valve of claim 16, including a tubular landing nipple, connected in the well tubing string above said tubing retrievable safety valve and having a length of tubing separating said landing nipple and said safety valve, and having conduit means, extending from a source of control pressure fluid at the surface of the well, to said tubing retrievable safety valve and received in said variable capacity pressure chamber, additional conduit means, extending from said tubing retrievable safety valve to said landing nipple, for conducting control pressure fluid therethrough, and said shiftable sleeve, positioned within the bore of said tubing retrievable safety valve, controlling the flow of said control pressure fluid to said landing nipple while said operator means is maintained in said second position.

18. The tubing retrievable safety valve of claim 16, including a profile in the bore of said shiftable sliding sleeve for receiving a shifting tool through the bore of said tubing string, and locking means associated with said sliding sleeve which prevents movement of said sliding sleeve to its unshifted position once said sliding sleeve has been shifted to maintain said operator means in its second position.

19. The tubing retrievable safety valve of claim 16, including means for controlling access of balance fluid to said variable capacity balance chamber.

20. The tubing retrievable safety valve of claim 19, including a tubular landing nipple, connected in the well tubing string above said tubing retrievable safety valve and having a length of tubing separating said landing nipple and said safety valve, and having first conduit means, extending from a source of control pressure fluid at the surface of the well, to said tubing retrievable safety valve and received in said variable capacity pressure chamber, second conduit means extending from the surface of the well to said tubing retrievable safety valve and received in said variable capacity balance chamber;

first flow passage means for directing said control pressure fluid from said tubing retrievable safety valve to said landing nipple, and second flow passage means for directing said balance fluid from said tubing retrievable safety valve to said landing nipple, said shiftable sliding sleeve, when shifted to a position wherein said operator means is moved to its second position, directs said control and said balance fluids from the surface of the well, through said tubing retrievable safety valve and thence to said landing nipple.

21. The tubing retrievable safety valve of claim 20, wherein said landing nipple has disposed in the bore thereof a shiftable sliding sleeve having a first position denying access of said control and balance fluids to said bore, and a second shifted position permitting access of control and balance fluids to said bore.

* * * * *

UNITED STATES PATENT AND TRADEMARK OFFICE

CERTIFICATE OF CORRECTION

PATENT NO. : 4,273,186

DATED : June 16, 1981

INVENTOR(S) : Joseph L. Pearce et al.

It is certified that error appears in the above—identified patent and that said Letters Patent is hereby corrected as shown below:

On the Title Page, Item [57], after "Tex." add and -- David Bills of Baldrock, Hartfordshire, England --.

Signed and Sealed this

*Twelfth* Day of *January 1982*

[SEAL]

*Attest:*

GERALD J. MOSSINGHOFF

*Attesting Officer*

*Commissioner of Patents and Trademarks*